United States Patent [19]

Cohen et al.

[11] 4,408,721

[45] Oct. 11, 1983

[54] FITTING TO COMBINE AIR AND PRESSURIZED WATER

[75] Inventors: Carlos Cohen, Toronto; Alfred Raab, Brampton, both of Canada

[73] Assignee: Jacuzzi Inc., Little Rock, Ak.

[21] Appl. No.: 237,532

[22] Filed: Feb. 23, 1981

[51] Int. Cl.[3] ..... E03C 1/084; B05B 7/12

[52] U.S. Cl. ..... 239/417; 239/428.5; 239/587; 411/423; 411/432

[58] Field of Search ..... 239/428.5, 417, 587; 411/423, 432; 285/206, 46; 128/66

[56] References Cited

U.S. PATENT DOCUMENTS

| | | | |
|---|---|---|---|
| 572,911 | 12/1896 | Schmidt | 285/46 |
| 658,085 | 9/1900 | Higbee | 411/423 X |
| 1,163,457 | 12/1915 | Regar | 285/46 |
| 2,557,106 | 6/1951 | Hughes | 239/587 X |
| 3,297,025 | 1/1967 | Jacuzzi . | |
| 3,471,091 | 10/1969 | Baker | 239/428.5 X |
| 3,540,438 | 11/1970 | Jacuzzi . | |
| 3,905,358 | 9/1975 | Jacuzzi . | |
| 4,082,091 | 4/1978 | Raab . | |
| 4,261,347 | 4/1981 | Spencer et al. . | |
| 4,262,371 | 4/1981 | Berry et al. | 239/587 X |
| 4,335,854 | 6/1982 | Reynoso | 239/587 X |

*Primary Examiner*—Andres Kashnikow
*Assistant Examiner*—Paul A. Sobel
*Attorney, Agent, or Firm*—Hill, Van Santen, Steadman & Simpson

[57] ABSTRACT

A hydro-air jet assembly wherein a ball-shaped element has a first passageway therethrough communicating with an air supply and a second passage therethrough communicating with a water supply which is rotatably mounted in a housing and has a venturi nozzle secured to the ball to corotate therewith but which is adjustable in an axial direction with respect to the ball member providing constant water and air flow rates through the ball and nozzle assembly regardless of the angular position of the ball. A venturi nozzle holder is used which provides a novel means of securing the adjustable venturi nozzle to the ball member. The hydro-air fitting is to be attached to a wall of a tub or pool by means of a clamping arrangement consisting of an annular abutment surface on the housing which abuts against the exterior or back of the wall that the fitting is to be mounted on and an escutcheon ring which clamps against the inner or front surface of the wall being mounted on and which is secured to the hydro-air fitting by means of a threaded nut. The nut and escutcheon ring have mating spherical surfaces that allow alignment between the fitting in a bathtub wall of an uneven thickness such that a water-tight joint is provided between the hydro-air fitting and the wall.

8 Claims, 4 Drawing Figures

FIG. 1
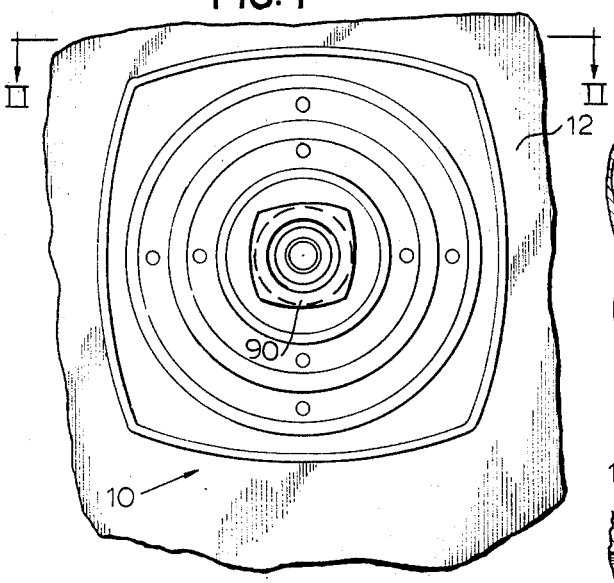
FIG. 2
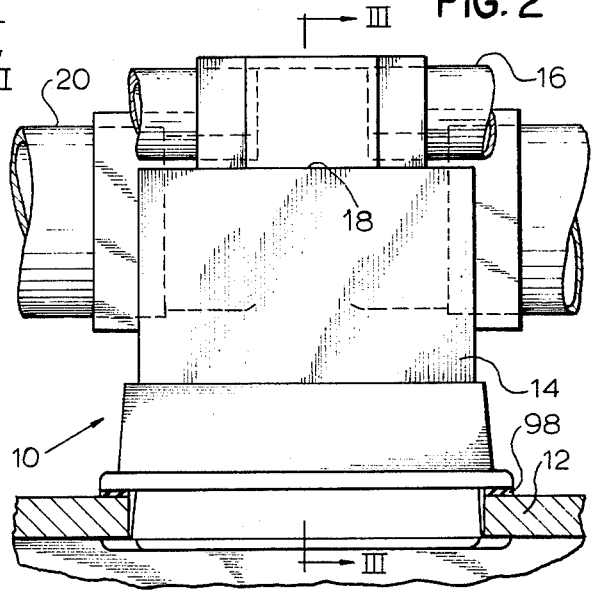
FIG. 3
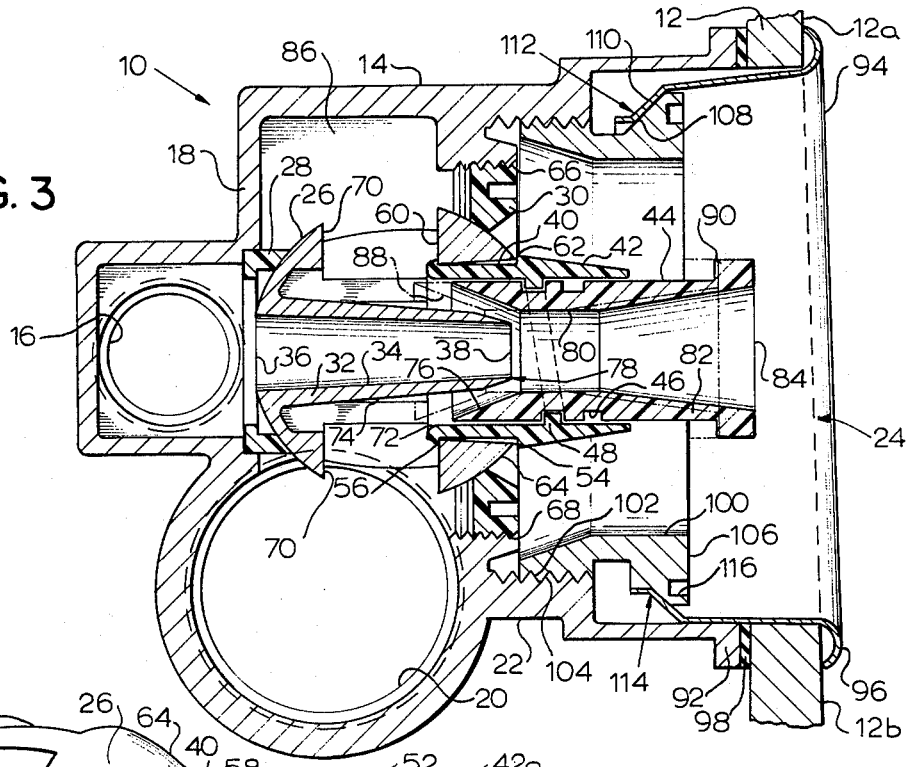
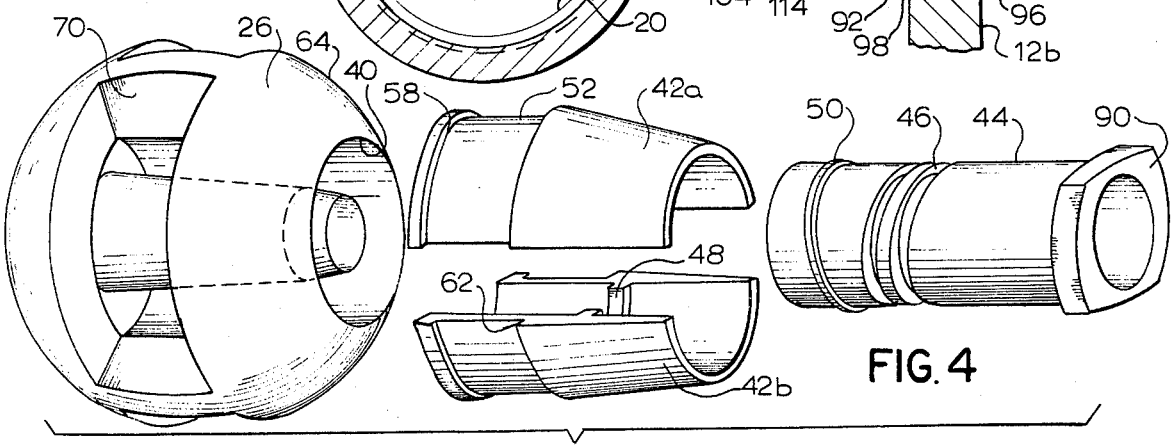
FIG. 4

FITTING TO COMBINE AIR AND PRESSURIZED WATER

BACKGROUND OF THE INVENTION

1. Field of the Invention

The present invention relates to an improvement in a fitting used to combine air with a pressurized water system in swimming pools, spas, and baths for aeration, hydrotherapy, hydromassage, and similar purposes.

2. Description of the Prior Art

The state of the art is represented by five patents owned or controlled by applicant's assignee. In Jacuzzi U.S. Pat. No. 3,297,025, a hydro-air fitting is disclosed with respect to FIGS. 2 and 6 in which a ball-shaped element is retained in a housing which has air and water supply connections. A first central passage is provided in the ball which communicates with the water supply connection. A second annular passage in the ball communicates with the air supply connection. Both passages in the ball communicate with the interior of a nozzle which comprises a mixing zone and which is an integral part of the ball and attached in a fixed relation thereto. The passage through the nozzle exits through a front opening in the housing in which the ball member is rotatably mounted. The nozzle is thus capable of a swiveling movement within the housing for directing the flow of aerated water to a desired location.

With respect to FIG. 4, a hydro-air jet assembly is disclosed in which a somewhat different ball-shaped member is swivelably retained in a housing having water and air supply connections. A first central passage is provided in the ball member which communicates with the water supply connection and which is selectively adjustable in an axial direction to vary the size of the opening between the passage and a mandrel allowing a varying degree of communication with the water supply connection. A second annular passage in the ball member communicates with the air supply connection and with the interior of a nozzle which also communicates with and is integral with the first passage in the ball. The interior of the nozzle thus forms a mixing zone for the air and water which then exits through the open front of the nozzle.

Jacuzzi U.S. Pat. No. 3,540,438 discloses a hydro-air jet head assembly which employs a jet head assembly similar to that disclosed in Jacuzzi U.S. Pat. No. 3,297,025 but which incorporates a recessed housing which is provided with a replaceable liner.

Jacuzzi U.S. Pat. No. 3,905,358 discloses a hydro-air fitting comprised of a housing having an air conduit connection and a water supply connection and a ball member rotatably mounted in the housing with an axial passage therethrough which communicates with the air supply connection and water supply connection. A venturi nozzle member is attached to the ball and rotates therewith and is axially adjustable thereto and has an axial passage therethrough which communicates with the passage in the ball. The air supply conduit form an L-shaped tubular member which protrudes into the center of the ball member passage but which is stationary with respect to the housing.

The venturi nozzle is selectively adjustable in an axial direction to vary the size of the opening between the nozzle passage and the air conduit tube allowing a varying degree of communication between the venturi nozzle and the water supply connection.

Raab U.S. Pat. No. 4,082,091 provides for a hydro-air fitting of the general configuration disclosed in Jacuzzi U.S. Pat. No. 3,905,358, described above, and provides an improved seat and sealing member for the ball member.

Spencer et al U.S. Pat. No. 4,261,347 provides for a further improvement of the seat and sealing member arrangement of Raab 4,082,091. (U.S. Ser. No. 100,921, filed Dec. 6, 1979).

SUMMARY OF THE INVENTION

The present invention comprises a hydro-air jet assembly in which a ball-shaped element is pivotally retained in a recessed housing which has air and water supply connections. A first central axial passage is provided in the ball which communicates with the air supply connection. A second annular passage in the ball communicates with the water supply connection. A venturi nozzle is rotatably retained within an opening in the front of the ball such that the nozzle is selectively adjustable in an axial direction with respect to the first central axial passage in the ball member. The passage through the venturi nozzle is permanently aligned with the first central axial passage through the ball member, thus providing that the annular space between the nozzle passage and the first central axial passage in the ball remains constant for any particular axial adjustment of the venturi nozzle regardless of the angular position of the ball and nozzle assembly in the recessed housing.

A venturi nozzle holder is used which provides a novel means of securing the adjustable venturi nozzle to the ball member. The venturi nozzle holder is made in halves for assembly around the venturi nozzle and snap insertion into the ball member to eliminate separate fasteners.

Mating threads on the interior of the nozzle holder and the exterior of the nozzle over part of their length serve to retain the nozzle in the nozzle holder and to limit the axial movement to predetermined positions of minimum and maximum flows.

The hydro-air fitting is attached to a wall of a tub, spa or pool by means of a clamping arrangement consisting of an annular abutment surface of the housing which abuts against the exterior or back of a wall and an escutcheon ring which clamps against an inner or front surface of the wall and which is secured to the hydro-air fitting by means of a threaded nut. The nut and escutcheon ring have mating spherical surfaces that allow alignment between the fitting and a wall of uneven thickness such that a water-tight joint is provided between the hydro-air fitting and the wall.

DESCRIPTION OF THE DRAWINGS

FIG. 1 is a front elevational view of the hydro-air fitting of the present invention.

FIG. 2 is a top view of the hydro-air fitting taken generally along the lines II—II of FIG. 1.

FIG. 3 is a side cross-sectional view of the hydro-air fitting taken generally along the lines III—III of FIG. 2.

FIG. 4 is an exploded view of the ball member, nozzle holder and nozzle shown in FIG. 3.

DESCRIPTION OF THE PREFERRED EMBODIMENTS

An improved hydro-air fitting 10 is shown in FIGS. 1, 2 and 3 as mounted in a wall 12 of a tub, pool or spa. As best seen in FIGS. 2 and 3, the fitting is comprised of a housing 14 which is recessed from the wall 12 and which has an air supply conduit 16 connected thereto at a rear wall 18 and a water supply conduit 20 connected thereto at a bottom wall 22. The housing is generally hollow with an open front end at 24.

A ball-shaped member 26 is pivotally retained within the hollow interior of the housing 14 and is seated against a rear seal 28 at a rear end thereof and an adjustable nut 30 at a front end thereof.

The nut 30 is axially adjustable to vary the tension placed on the ball member 26 to provide for a water-tight seal between the ball member 26 and the rear seal 28 and the nut 30. Since the ball member 26 is rotatable or swivelable in its mounting between the rear seal 28 and the nut 30, appropriate plastic materials may be used to aid in promoting the seal and reducing the friction between these members.

The ball member 26 is formed with a central hollow tubular member 32 defining a first central passage 34 therein having a rear opening 36 through the rear end of the ball and a front opening 38 near the front of the ball member 26. The ball member 26 has an enlarged front opening 40 which receives a nozzle holder 42 and a venturi nozzle 44.

As seen in FIG. 4, the nozzle holder 42 may be formed in halves 42*a*, 42*b* to facilitate construction of the assembly. Then venturi nozzle 44 is provided with an exterior spiral shaped groove 46 which is designed to mate with an interior sprial thread 48 formed in the nozzle holder 42. A sealing ring 50 is also provided on the exterior of the nozzle 44 to provide for a water-tight seal between the nozzle 44 and the nozzle holder 42. The nozzle holder 42 has a wide annular groove 52 formed on the exterior surface thereof which is used to retain the nozzle holder 42 in the ball member 26.

As best seen in FIG. 3, the enlarged front opening 40 in the ball member 26 has an exterior diameter 54 which is greater than an interior diameter 56.

In constructing the assembly, the nozzle 44 is first placed between the two halves 42*a*, 42*b* of the nozzle holder 42 such that the thread 48 of the nozzle holder 42 mates with the groove 46 in the nozzle 44. This subassembly is then inserted into the opening 40 of the ball member 26 through the somewhat enlarged exterior diameter 54. A first wall 58 of the groove 52 acts as a lip to retain the nozzle holder 42 against an interior wall 60 of the ball member 26. A second wall 62 acts as a lip which abuts against the exterior surface 64 of the ball member 26 to prevent the nozzle holder 42 from moving inward with respect to the ball. Thus the nozzle holder 42 is permanently secured in a fixed relation with respect to the ball 26. To further facilitate in the assembly of the nozzle holder 42 with the ball member 26, the nozzle holder 42 may be made of a resilient plastic material which will allow the first wall 58 of the groove 52 to compress somewhat to fit through the opening 40 and then will cause it to spring back to its original position to act as a lip as described above.

The ball and nozzle assembly is positioned in the housing 14 such that the rear end of the ball is positioned against the rear seat 28 and then the nut 30 which has an exterior threaded diameter 66 which mates with a threaded opening 68 in the housing is tightened against the front of the ball 26 permitting swivelable movement of the ball in the housing and providing a water-tight seal between the ball member 26, the rear seal 28 and the nut 30.

In this manner, the rear opening 36 in the ball member 26 communicates with the air supply conduit 16 at the rear of the housing. Side wall openings 70 provide communication between the water supply conduit 20 and the open front end 40 of the ball 26. This communication path forms a second annular passage through the ball.

As seen in FIG. 3, water from the water supply conduit 20 flows under pressure through openings 70 in the side wall of the ball 26, and then between an interior wall 72 of the nozzle holder 42 and an exterior wall 74 of the hollow tubular member 32, then between a converging interior wall 76 of the nozzle 44 and the exterior wall 74 of the tube 32 including a beveled portion 78 at the front opening 38, then through a constricted neck portion 80 of the nozzle 44 and out through a diverging portion 82 of the nozzle to exit through a front opening 84 in the nozzle. Since the water in the conduit 20 is under pressure, and the openings 70 in the ball are larger in area than the path between the tubular member 32 and the converging section of the nozzle 76, a chamber 86 in the housing which communicates with opening 70 also fills with water under pressure to provide for a uniform flow of water through the path described above.

The path for the flow of air through the hydro-air assembly is from the air supply conduit 16 through the rear opening 36 in the ball member 26, through the first central passage 34 in the tubular member 32, through the front opening 38 in the tubular member, then into the constricted neck portion 80 of the nozzle 44 where it mixes with the water to form a stream of aerated water which flows through the diverging section 82 of the nozzle and out through the front opening 84. The flow of pressurized water through the nozzle creates a low pressure area in the neck portion 80 which draws air through the central passage 34 from the air conduit 16.

The ball member 26 is selectively pivotable in the housing to allow a user to direct the stream of aerated water in a desired direction.

The nozzle 44 can be rotated with respect to the nozzle holder 42 which causes the thread 48 on the interior of the nozzle holder 42 to advance in the groove 46 in the nozzle thereby resulting in the nozzle moving in an axial direction. As the nozzle 44 is moved toward the ball 26, the distance between the converging wall 76 of the nozzle and the exterior wall 74 and bevel portion 78 of the tubular member 32 is reduced thereby reducing the amount of water which can flow through the hydro-air fitting. A first or full open position is shown by the nozzle in solid lines in FIG. 3 and a second partially closed position is shown in phantom at 88. The thread 48 and groove 46 can be arranged to provide a preselected maximum and minimum flow of air and water through the hydro-air fitting. Ears 90 are provided on the end of the nozzle 44 to aid in gripping the nozzle and to assist in rotating the nozzle with respect to the nozzle holder 42 and for pivoting the ball member 26 and pointing the nozzle 44 in a desired direction.

As described above, the housing 14 is to be mounted in a wall 12 of a pool, tub or spa and it is contemplated that the housing is recessed, that is that the nozzle and ball assembly are placed within the wall and do not protrude therefrom. The housing 14 is secured to the wall 12 by means of a clamping action between a flange 92 around the perimeter of the front of the housing 14 and an escutcheon 94 which has a radially outwardly extending lip portion 96 which acts as a clamping surface. A sealing ring 98 is placed between the flange 92 and the wall 12 to provide for a water-tight seal between the housing 14 and the wall 12. The escutcheon 94 is clamped against the wall 12 by means of a nut 100 which has a threaded exterior diameter 102 at a rear end thereof which mates with a threaded hole 104 in the housing 14. The front portion of the nut 100 has a flange portion 106 which has a curved rear wall 108 for receiving a curved portion 110 of the escutcheon. The curved nature of these two surfaces permits a secure and water-tight joint between the hydro-air fitting and a wall 12 of uneven thickness. As seen in FIG. 3, the upper wall portion 12*a* is thinner than the lower wall portion 12*b*. This causes the curved portion 110 of the escutcheon 94 to engage more surface of the nut 100 in the upper portion and to engage less surface of the nut at the lower portion as shown at 114. Gripping holes 116 are provided in the nut 100 to assist in tightening and loosening the nut.

Thus it is seen that an improved hydro-air fitting has an adjustable venturi nozzle which can be used to control the rate of flow and direction of the jet of aerated water. By incorporating the air nozzle through which the air enters the hydro-air fitting with the ball member, consistant performance by the hydro-air fitting is achieved for any particular axial adjustment of the venturi nozzle regardless of the angular position chosen. The novel means of securing the adjustable venturi in the fitting allows for a range of flow rates between a first open and second closed or paritally closed position of the nozzle. Thus the nozzle is prevented from being removed from the assembly. Additionally, the hydro-air fitting can be secured in a water-tight manner to a wall having an uneven thickness.

We claim:

1. In a hydro-air fitting assembly for controlling and directing a flow of aerated water including a housing, a hollow ball member pivotable in said housing and having passages therein for directing a flow of water and a flow of air, and a nozzle member co-pivotable with said ball having an axial passage therethrough where said air flow and water flow mix, a nozzle holder to be received in said ball and having a central passage therethrough for telescopingly receiving said nozzle, means formed on said nozzle and said nozzle holder to provide for axial adjustment of said nozzle with respect to said ball between a first open position and a second paritally closed position, said means comprising a channel of limited duration, which channels's ends terminate inboard of the ends of the member of which it is a part, and means formed on said nozzle holder and said ball to permanently retain said nozzle holder in a fixed axial position after insertion into said ball, whereby no additional elements are required to secure said nozzle holder in said ball or to limit the axial movement of said nozzle.

2. The device of claim 1 wherein said nozzle holder is formed in two separate halves which are enclosed around said nozzle to form a unit to be inserted into said ball.

3. A hydro-air fitting assembly for controlling and directing a flow of aerated water comprising:

a generally hollow housing having a first supply connection for air and a second supply connection for water and further having a generally open front end, a generally hollow ball member having a first central passage therethrough defined by an axially disposed tube having a first opening at a rear end of said ball and a second opening at an open front end of said ball, said ball member further having openings through sidewalls which define a second annular passage between said sidewall openings and said open front end, said ball member being rotatably mounted in said housing by a single retaining element comprising a nut having a central opening sized to engage a portion of the spherical outer surface of said ball and being axially adjustable to abut and retain said ball in said housing such that said first passage in said ball communicates with said first supply connection in said housing and said second passage in said ball communicates with said second supply connection in said housing, and said open front end in said ball is directed toward said open front end in said housing, a venturi nozzle retained in said open front end of said ball to corotate therewith by means of a nozzle holder received in said open front end of said ball and having a central passage therethrough and which telescopingly receives and nozzle in said passage, said nozzle holder having external threads thereon and said nozzle member having a channel formed in an exterior surface thereof which channel's ends terminate inboard of the ends of said nozzle to provide for axial adjustment of said nozzle with respect to said ball between a first open position and a second partially closed position, said nozzle holder further being formed in two separate halves which are enclosed around said nozzle to form a unit and are inserted into said open front end of said ball for permanent retention of said nozzle within said ball without additional fasteners, said nozzle having an axial passage therethrough which is aligned with said first passage in said ball, said axial passage comprising a mixing zone having a rear opening which communicates with said open front end of said first passage of said ball and which also communicates with said second passage of said ball and a front opening which is directed toward said open front end in said housing.

4. A hydro-air fitting assembly for controlling and directing a flow of aerated water comprising:

a generally hollow housing having a first supply connection for air and a second supply connection for water and further having a generally open front end, a generally hollow ball member having a first axial passage therethrough and a second annular passage therethrough, said ball member pivotally mounted in said housing by a single retaining element comprising a nut having a central opening sized to engage a portion of the spherical outer surface of said ball and being axially adjustable to abut and retain said ball in said housing such that said first axial passage in said ball communicates with said first supply connection in said housing and said second annular passagse in said ball communicates with said second supply connection in said housing, a venturi nozzle having a passage therethrough comprising a converging section, a constricted throat section, and a diverging section, means for retaining said nozzle in said housing to copivot with said ball by means of a nozzle holder received in said ball and having a central passage therethrough and which telescopingly receives said nozzle in said passage, said nozzle holder having external thread thereon and said nozzle member having a channel formed in an exterior surface thereof which channel's ends terminate inboard of the ends of said nozzle member to provide for axial adjustment of said nozzle with respect to said ball between a first open position and a second partially closed position, said nozzle holder further being formed in two separate halves which are enclosed around said nozzle to form a unit and are inserted into said ball for permanent retention of said nozzle within said ball without additional fasteners, said passage in said nozzle communicating at one end with both passages in said ball, and at another end with said open front end of said housing.

5. A hydro-air fitting assembly for controlling and directing a flow of aerated water comprising:

a generally hollow housing having a first supply connection for air and a second supply connection for water and further having a generally open front end, a ball member having first and second passages therethrough, said ball member pivotally mounted in said housing by a single retaining element comprising a nut having a central opening sized to engage a portion of the spherical outer surface of said ball and being axially adjustable to abut and retain said ball in said housing such that said first passage in said ball communicates with said first supply connection in said housing and said second passage in said ball communicates with said second supply connection in said housing, a nozzle having a passage therethrough comprising a converging section, a constricted throat section, and a diverging section, means for retaining said nozzle in said housing to copivot with said ball by means of a nozzle holder received in said ball and having a central passage therethrough and which telescopingly receives said nozzle in said passage, said nozzle holder having external threads thereon and said nozzle member having a channel formed in an exterior surface thereof which channel's ends terminate inboard of the ends of said nozzle member to provide for axial adjustment of said nozzle with respect to said ball between a first open position and a second partially closed position, said nozzle holder further being formed in two separate halves which are enclosed around said nozzle to form a unit and are inserted into said ball for permanent retention of said nozzle within said ball without additional fasteners, said converging passage section in said nozzle communicating with both passages in said ball and said diverging passage section communicates with said open front in said housing.

6. A hydro-air fitting assembly for controlling and directing a flow of aerated water comprising:

a generally hollow recessed housing having a first supply connection for air and a second supply connection for water and further having a generally open front end defined by a circumferential abutment surface, a ball member having first and second passages therethrough, said ball member pivotally mounted in said housing by a single retaining element comprising a nut having a central opening sized to engage a portion of the spherical outer surface of said ball and being axially adjustable to abut and retain said ball in said housing such that said first passage in said ball communicates with said first supply connection in said housing and said second passage in said ball communicates with said second supply connection in said housing, a nozzle having a passage therethrough comprising a converging section, a constricted throat section, and a diverging section, means for retaining said nozzle in said housing to copivot with said ball by means of a nozzle holder received in said ball and having a central passage therethrough and which telescopingly receives said nozzle in said passage, said nozzle holder having external threads thereon and said nozzle member having a channel formed in an exterior surface thereof which channel's ends terminate inboard of the ends of said nozzle to provide for axial adjustment of said nozzle with respect to said ball between a first open position and a second partially closed position, said nozzle holder further being formed in two separate halves which are enclosed around said nozzle to form a unit and are inserted into said ball for permanent retention of said nozzle within said ball without additional fasteners, said converging passage section in said nozzle communicating with both passages in said ball and said diverging passage section communicates with said open front in said housing, an escutcheon having a radially outwardly extending lip portion and a spherically shaped portion extending radially inwardly, said escutcheon being sized to be received in said open front end of said housing and said flange portion sized to overlap said abutment surface of said housing, a nut having a spherical shaped rear wall, whereby said spherical shaped wall of said nut engages said escutcheon against said housing to clampingly retain said housing on a wall portion which is clamped between said escutcheon flange and said abutment surface.

7. The hydro-air fitting assembly of claim 6, wherein said escutcheon and said nut are rotationally adjustable such that said housing can be clamped on a wall of uneven thickness in a water-tight manner.

8. The device of claim 3 wherein said nozzle holder has an exterior surface shaped to mate with an interior surface shape at said open front end of said ball whereby said nozzle holder is permanently retained in a fixed axial position after insertion into said ball.

* * * * *